US008956031B2

(12) United States Patent
Silberman

(10) Patent No.: US 8,956,031 B2
(45) Date of Patent: Feb. 17, 2015

(54) PRODUCTS INCORPORATING FIBER OPTICS

(75) Inventor: Barry Silberman, Boca Raton, FL (US)

(73) Assignee: Inkology, Inc., Boca Raton, FL (US)

( * ) Notice: Subject to any disclaimer, the term of this patent is extended or adjusted under 35 U.S.C. 154(b) by 180 days.

(21) Appl. No.: 13/479,655

(22) Filed: May 24, 2012

(65) Prior Publication Data

US 2013/0314930 A1 Nov. 28, 2013

(51) Int. Cl.
*F21V 7/04* (2006.01)

(52) U.S. Cl.
USPC ..... 362/554; 362/551; 362/565

(58) Field of Classification Search
USPC ..... 362/551, 554–556, 563–565, 567–571, 362/577
See application file for complete search history.

(56) References Cited

U.S. PATENT DOCUMENTS

| | | | | |
|---|---|---|---|---|
| 4,559,583 | A | 12/1985 | Ku | |
| 4,875,144 | A | 10/1989 | Wainwright | |
| 4,975,809 | A | 12/1990 | Ku | |
| 6,151,439 | A | 11/2000 | Wainwright | |
| 6,198,872 | B1 | 3/2001 | Lipson et al. | |
| 6,217,188 | B1 | 4/2001 | Wainwright et al. | |
| 6,302,570 | B1 | 10/2001 | Petell et al. | |
| 6,361,075 | B1 | 3/2002 | Ritter et al. | |
| 7,349,608 | B2 | 3/2008 | Silberman | |
| 7,559,902 | B2 * | 7/2009 | Ting et al. | 600/529 |
| 2002/0145280 | A1 | 10/2002 | Bock | |
| 2005/0036303 | A1 | 2/2005 | Yu et al. | |
| 2005/0057941 | A1 | 3/2005 | Pederson et al. | |

FOREIGN PATENT DOCUMENTS

| | | |
|---|---|---|
| JP | 2002240489 | 8/2002 |
| JP | 2003237292 | 8/2003 |

OTHER PUBLICATIONS

Sketchers Boy's Luminators: Nova Wave, http://www.skechers.com/style/90290/luminators-nova-wave/bklm, screenshot captured Jul. 25, 2012.

Best Buy Neon Signs, LED Signs, Scrolling LED Signs, http://www.bestbuyneonsigns.com/, screenshot captured Jul. 25, 2012.

* cited by examiner

*Primary Examiner* — Evan Dzierzynski
*Assistant Examiner* — Meghan Dunwiddie
(74) *Attorney, Agent, or Firm* — Robert M. Schwartz

(57) ABSTRACT

An object has fiber optics or other light emitting portion, the operation of which is triggered by temperature, sound, fingerprint or motion. In preferred embodiments the light emitting portion cooperates with a non-light emitting portion to enhance the ornamental design, and in especially preferred embodiments a portion of the ornamental design appears to be moving by virtue of triggering of different bundles of fiber optics.

20 Claims, 4 Drawing Sheets

PRODUCTS INCORPORATING FIBER OPTICS

FIELD OF THE INVENTION

The field of the invention is products that utilize light emitting materials in ornamental designs.

BACKGROUND

Over the past several years lights have been incorporated into several products that had not historically been lighted. Examples include stationary products, sneakers, buildings, and signs. Examples of such products include Sketchers™ sneakers found at http://www.skechers.com/style/90290/luminators-nova-wave/bklm, Applicant's stationary products incorporating fiber optics as described in U.S. Pat. No. 7,349,608, and neon signs such as the ones found at http://www.bestbuyneonsigns.com/.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

However, the above mentioned products are sometimes problematic because they sometimes light up when no one is around to appreciate the view, or fail to light up when someone is around to appreciate it. For example, the sneakers mentioned above are configured to light up with each step taken by the wearer, which can be somewhat silly during daytime hours where the light is barely visible. As another example, stationary products and neon signs require activation of a manual switch in order to light up, which can reduce the spontaneity that could otherwise be derived from a lighted notebook or other object.

Thus, there is still a need for improved products incorporating ornamental designs.

SUMMARY OF THE INVENTION

The inventive subject matter provides apparatus, systems and methods in which a power source or power converter, light source, a light transmitting material, light emitting points, a sensor, a controller (e.g. a printed circuit board, wire wrap, or point-to-point construction) and a non-light emitting portion are configured to display an ornamental design on a base object. A non-light emitting portion could comprise the material(s) that the base object itself is made of, or an engraving, paint, stitching, strip of fabric, wire, or other material that is stitched on, glued on, or otherwise incorporated therein.

As used herein, the term "light emitting point" is used very broadly to include any relatively small ($\leq 12$ mm$^2$) visually distinct area that emits light.

It is contemplated that the light emitting points could be of various shapes and sizes. The surface area of the exposed portion of a point is preferably less than 6 mm$^2$, more preferably less than 4 mm$^2$, and most preferably less than 1 mm$^2$. Each point could be illuminated with visible light from any suitable light source. Contemplated light sources include light emitting diodes (LEDs), and less preferably, incandescent bulbs and compact fluorescent light sources.

It is contemplated that an object could comprise any suitable number of light emitting points configured to form a design. Some or all of these points could derive their colors directly from the color of the light source, or from some intermediate filter, including for example a tint coating on the actual point. Larger points could derive their colors from two or more different color tint coatings.

As used herein, the term "light transmitting material" is used very broadly, to include any material capable of transmitting light from a light source to a point of emission. Examples include fiber optics.

A base object comprising an ornamental design could be functional and/or decorative. Indeed, many preferred objects include both functional features and at least one ornamental design.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Various types of sensors are contemplated, including for example, a fiber optic sensor, an ambient motion detector, a temperature detector, a biometric information detector (e.g. a fingerprint detector), a sound detector, a manual switch, or any combination thereof.

A controller that cooperates with a sensor could be configured to cause a light source to emit light either immediately upon the detecting of a temperature, sound, fingerprint or movement, or upon a delay. It is further contemplated that a controller could cooperate with the sensor to cause a light source to emit a light only upon the sensing of two or more of a temperature, sound, fingerprint, or movement. Moreover, the timing or pattern of the emission of light could be different based on what is detected by the sensor. Thus, an ornamental design comprising a regular face could smile immediately when the sensor detects laughter, frown immediately when the temperature gets colder, and wink after a delay when the sensor is touched.

In some preferred embodiments, an object could comprise three, four, five, six, seven, or possibly even a hundred or more at least partially distinct areas of light emitting material. In such embodiments, two or more of these areas could be configured to light up at different times to give a viewer the impression that: (1) at least a portion of an animal is (a) smiling, winking, grinning, smirking, frowning, or making another facial movement, (b) walking, flying, crawling, making a hand gesture, bouncing, spinning, skating, gliding, falling, shaking, rising, dancing, growing, shrinking, or otherwise moving a body; (2) at least a portion of an inanimate object is expanding, shrinking, rotating, zig-zagging, snaking, shaking, or otherwise moving; or (3) at least a portion of a plant, tree, or flower is growing, shrinking, rotating, dying, changing colors, or otherwise moving.

As used herein, the term "distinct area" as used with respect to the lighted portion of an ornamental design, means any area where the light emitting points operate as a group to depict a position of an imaged portion of the design. In some cases a single bundle exclusively terminates in a given area, and that area would then be considered a distinct area. In other cases fibers from two or more bundles could terminate in a given area, and if they are illuminated together, the area in which they terminate would also be considered a distinct area. The term "a partially distinct area" is used herein to accommodate aberrant lighting situations, where less than 5% of the light emitting points are misplaced. For example, an ornamental design of a person might have 50 light emitting points that illuminate together in the head and upper body, another 25 in the legs in one walking position, and another 25 in the legs of another walking position. There would be "three distinct areas" as the term is used herein because the head and torso would light up together, and each of the two legs would light up together. But if one of the 25 fibers were positioned in the wrong leg, the leg regions would be "partially distinct."

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used herein, the term "base object" is used very broadly to include any tangible object of any shape, size, configuration, or functionality. A base object could comprise any suitable material, including for example, glass, metal, a steel, fabric, paper, plastic, rubber, wood, any synthetic material, any non-synthetic material, any organic material, or any combination thereof. Base objects include, for example: (a) a hat, a glove, a footwear, or any other clothing accessory; (b) a jacket, a sweater, a shirt, a pair of pants, or any other article of clothing; (c) a necklace, a ring, a bracelet, or any other piece of jewelry; (d) a representation of a dog, cat, human, or any other animal; (e) a representation of a plant, a tree, a flower, or any other plant; (f) a toy; (g) a journal, a notebook, a diary, a binder, a pencil pouch, a locker accessory (e.g. mirror, bin, dry erase board, chalk board), a writing instrument, a memo pad holder, or any other item of stationary; (h) a laptop, a mouse pad, or other computer related products; (i) a table, chair, countertop, storage container, or other piece of furniture; or any other tangible object.

Various objects, features, aspects and advantages of the inventive subject matter will become more apparent from the following detailed description of preferred embodiments, along with the accompanying drawing figures in which like numerals represent like components.

DETAILED DESCRIPTION OF THE DRAWINGS

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
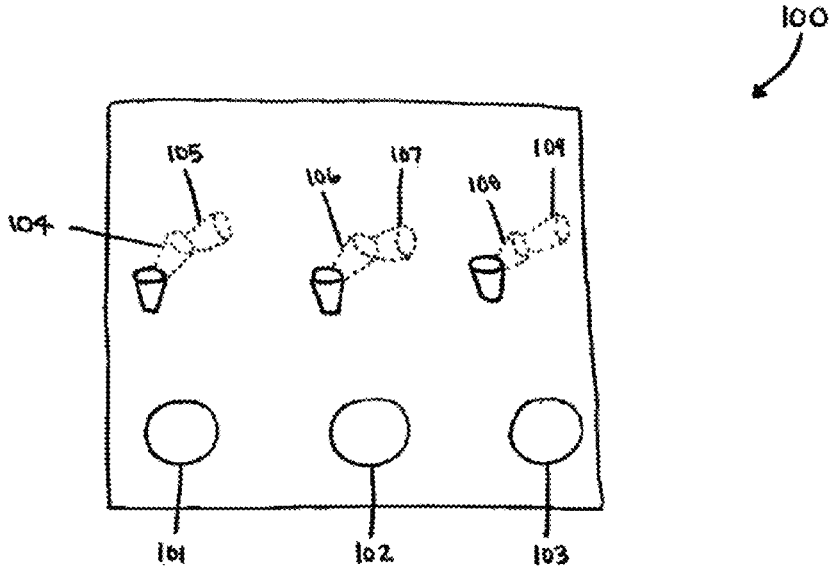
FIG. 1 is an aerial view of a tabletop or other item of furniture incorporating fiber optics.

Referring first to FIG. 1, an item of furniture 100 (e.g. a table) is coupled with three sensors 101, 102 and 103 each coupled to a controller (not shown) and two or more at least partially distinct areas of light emitting material 104-109. The first sensor 101 and controller are coupled to areas 104 and 105, the second sensor 102 and controller are coupled to areas 106 and 107, and the third sensor 103 and controller are coupled to areas 108 and 109. Upon an event (e.g. cup leaving the table in the sensor area) being detected by a sensor, the controller will cause the corresponding areas to light up in any pre-determined order. This order could be concurrent, repeatedly alternating, sequential, sequential with a delay, sequential with varying delays, and so forth.

Figure 2:
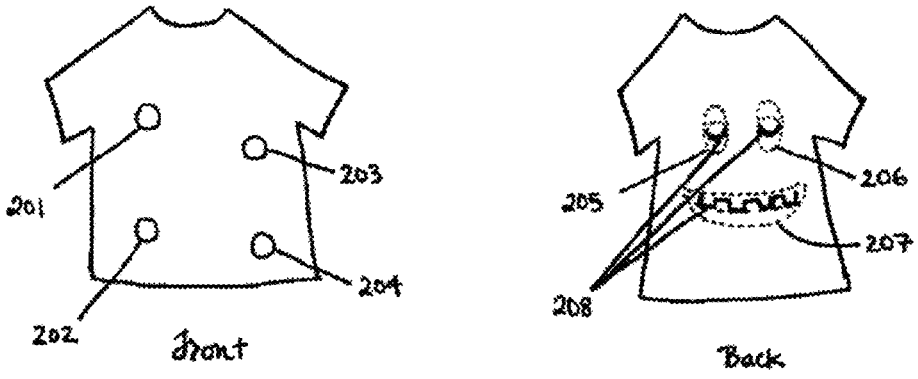
FIG. 2 is a frontal and rear view of a t-shirt or other item of clothing incorporating fiber optics.

FIG. 2 shows a frontal and rear view of an item of clothing 200 (e.g. a t-shirt incorporating fiber optics. Each of the plurality of sensors 201, 202, 203, and 204 are linked to the same at least partially distinct areas of light emitting materials 205, 206, and 207. When the wearer is given a hug (or any of the sensors are otherwise triggered), the three areas will light up simultaneously in the back so that an observer would see a happy face light up on top of a stitched on sleeping face 208 upon a hug or other sensed act.

Figure 3:
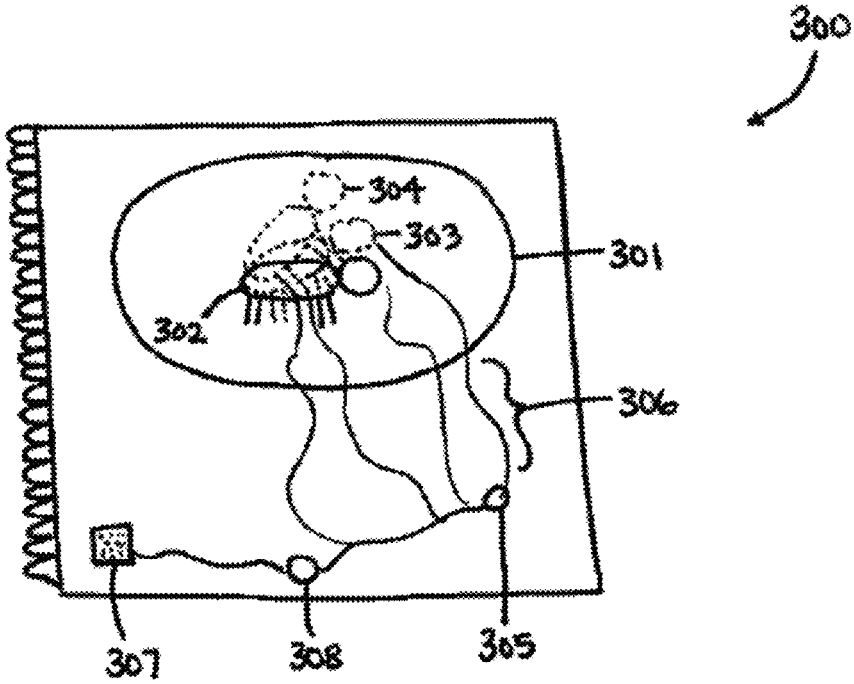
FIG. 3 is a perspective view of a notebook or other stationary product incorporating fiber optics.

FIG. 3 shows a perspective view of a front cover of an item of stationary 300 (e.g. a notebook) incorporating fiber optics. Sensor 305 detects a sound and activates the controller 306 to light up the first at least partially distinct area 303 after a short delay (e.g. 2 seconds), followed by the second area 304 after a second delay (e.g. 1 second) to create the impression that the engraved dog 302 is lifting its front legs. During the 3 seconds that the dog is lifting its front legs, sensor 305 activates a second controller 308 to cause a sound to come out of speaker 307. Thus, when the sensor detects a sound, activation of light bundles within the ornamental design could create the impression that a dog is lifting its front legs and barking.

Figure 4:
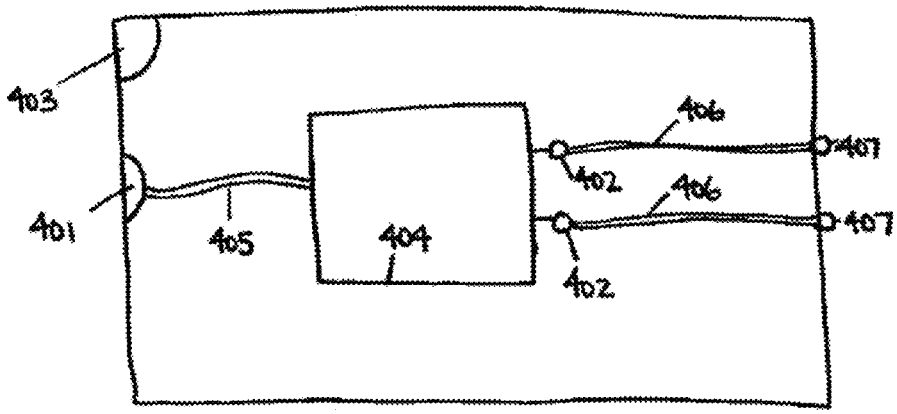
FIG. 4 shows a cross sectional view of one embodiment of an object showing where the wiring and electronic equipment is disposed.

FIG. 4 shows a cross sectional view of a base object 400 incorporating one possible configuration of electrical components. A power source or power converter 401 provides power to the light source 402, which is coupled to a light transmitting material 406 and light emitting point 407. This power is provided to the controller 404 when a sensor 403 detects a pre-determined motion, fingerprint, sound, or temperature, and then the controller 404 provides power to the light source 402. The power source or power converter 401 and controller 402 could be communicatively coupled by wires 405, or wirelessly. Contemplated power sources and power converters include, among other things, batteries and solar power sources.

Figure 5:
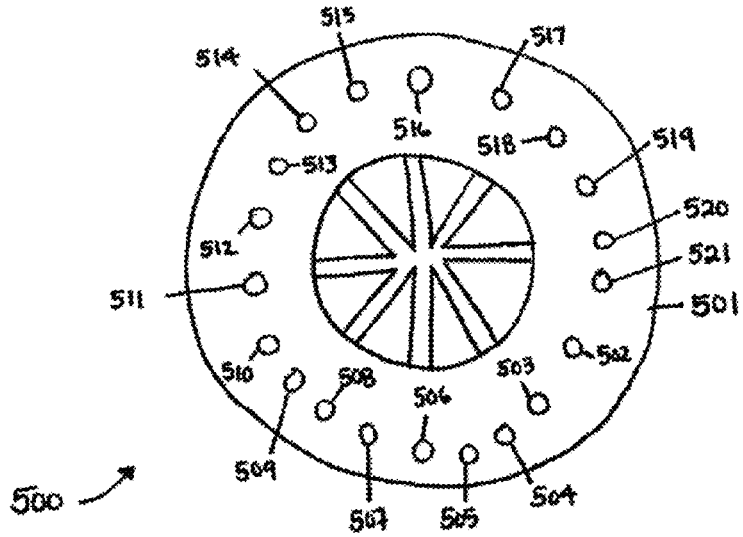
FIG. 5 is a side view of a tire incorporating fiber optics.

FIG. 5 is a side view of a tire 500 on a toy (not shown) incorporating fiber optics. Light emitting points 502-521 are located on a non-light emitting portion 501.

Figure 6:
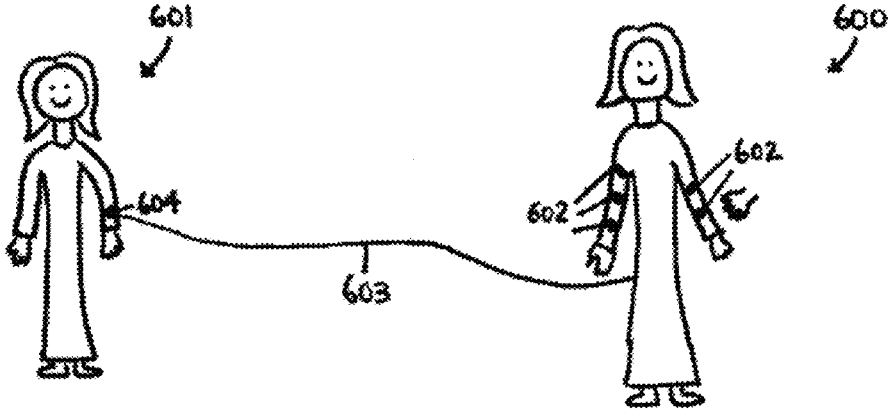
FIG. 6 is a perspective view of an ordinary dress (i.e. without an ornamental design) with sensors coupled to a dress incorporating fiber optics.

It is further contemplated that detection of a movement, sound, fingerprint or temperature by a sensor on one object could cause at least a portion of an ornamental design to light up on a separate object as shown in FIG. 6. For example, a base dress 600 comprising various sensors 602 could be placed on a mannequin. This dress could be associated with an object 601 worn by a person that comprises an ornamental design. Then, when a sensor on the dress worn by the mannequin is touched, the corresponding at least partially distinct portion(s) 604 on the dress worn by the person could light up. The two dresses could be coupled through wiring 603 or any other suitable apparatus.

In some preferred embodiments, sensors could be user configured to detect some specific motion, sound, temperature, fingerprint, or other unique feature. For example, a sensor on a wall could allow a user to record a voice code, which must be repeated in the same tone, volume, or rhythm to activate the light source(s) coupled to the ornamental design. It is also contemplated that the length of time the light source (s) will stay active before powering down for a later use could be user configured.

Figure 7:
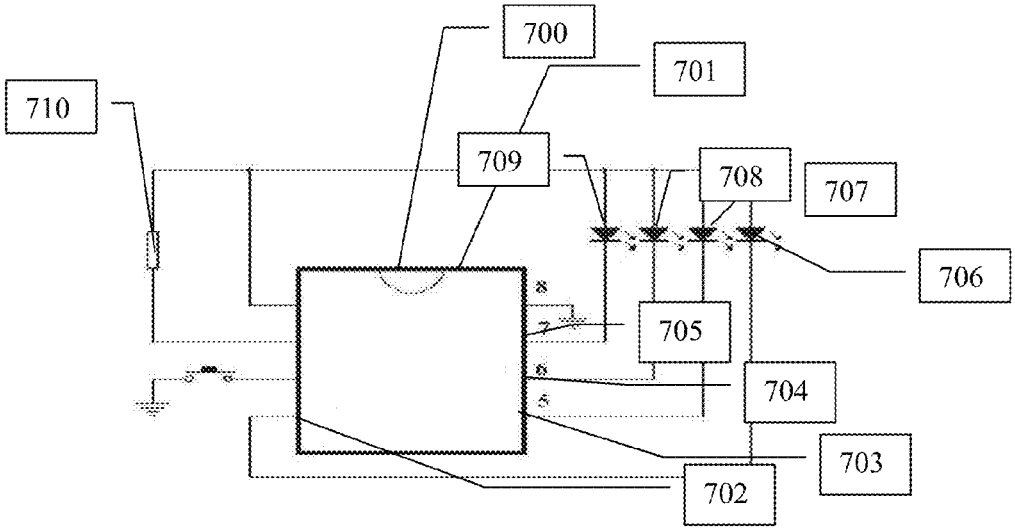
FIG. 7 is a diagram of one possible electrical structure.

FIG. 7 is a diagram of one possible configuration of electrical components. The power source or power converter 710 is coupled to a sensor 700 and controller 701. When the sensor 700 detects a pre-determined motion, sound, temperature, fingerprint, or other unique feature, power is transmitted to the controller, and from the controller 701 to the light sources 702-705, which causes the light sources 702-705 to emit light, which is then transmitted to the light emitting points 706-709 at the surface of the decorative object.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An object comprising:

a surface displaying an ornamental design comprising a light emitting portion and a non-light-emitting portion; wherein the light emitting portion includes at least three light emitting areas that are at least partially distinct;

a sensor configured to detect at least one of (a) temperature, (b) sound, and (c) ambient motion about the object; and a controller that cooperates with the sensor and the light emitting portion to control an operation of the light emitting portion.

2. The object of claim 1, wherein the controller is configured to activate each of the at least three light emitting areas in a pattern that cooperates with at least a portion of the non-light-emitting portion to give an impression of at least one of a walking movement, a flying movement, and a crawling movement.

3. The object of claim 1, wherein the controller is configured to activate each of the at least three light emitting areas in a pattern that cooperates with at least a portion of the non-light-emitting portion to give an impression of a facial movement.

4. The object of claim 1, wherein the controller is configured to activate each of the at least three light emitting areas in a pattern that cooperates with at least a portion of the non-light-emitting portion to give an impression of a hand movement.

5. The object of claim 1, wherein the light emitting and non-light-emitting portions cooperate to illustrate at least a portion of at least one of a hat, a glove, and a footwear.

6. The object of claim 1, wherein the light emitting and non-light-emitting portions cooperate to illustrate at least a portion of at least one of a jacket, a sweater, a shirt, and a pair of pants.

7. The object of claim 1, wherein the light emitting and non-light-emitting portions cooperate to illustrate at least a portion of a piece of jewelry.

8. The object of claim 1, wherein the light emitting and non-light-emitting portions cooperate to illustrate at least a portion of an animal.

9. The object of claim 1, wherein the light emitting and non-light-emitting portions cooperate to illustrate at least a portion of a plant.

10. The object of claim 1, wherein the light emitting and non-light-emitting portions cooperate to illustrate at least a portion of a tree.

11. The object of claim 1, wherein the sensor includes a fiber optic component.

12. The object of claim 1, wherein the sensor includes an ambient motion detector component.

13. The object of claim 1, wherein the sensor includes a temperature detector component.

14. The object of claim 1, wherein the sensor includes a sound detector component.

15. The object of claim 1, wherein the controller is configured to activate the light emitting portion after a delay of 2-10 seconds, inclusive, after receiving an activation signal from the sensor.

16. The object of claim 1, wherein the object comprises glass.

17. The object of claim 1, wherein the surface comprises a fabric.

18. The object of claim 1, wherein the surface is at least partially metallic.

19. The object of claim 1, wherein the object comprises a toy.

20. The object of claim 1, wherein the object comprises an item of stationary.

* * * * *